US009669623B2

(12) United States Patent
Perez Gellida et al.

(10) Patent No.: US 9,669,623 B2
(45) Date of Patent: Jun. 6, 2017

(54) SELECTIVELY HEATING A PRINT ZONE OF A PRINTING SYSTEM

(71) Applicant: Hewlett-Packard Development Company, L.P., Houston, TX (US)

(72) Inventors: Francisco Javier Perez Gellida, Barcelona (ES); David Toissaint, Barcelona (ES); Antonio Garcia Verdugo, Barcelona (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/022,522

(22) PCT Filed: Sep. 19, 2013

(86) PCT No.: PCT/US2013/060517
§ 371 (c)(1),
(2) Date: Mar. 16, 2016

(87) PCT Pub. No.: WO2015/041646
PCT Pub. Date: Mar. 26, 2015

(65) Prior Publication Data
US 2016/0236465 A1 Aug. 18, 2016

(51) Int. Cl.
*B41J 2/045* (2006.01)
*B41J 2/42* (2006.01)
(Continued)

(52) U.S. Cl.
CPC ..... *B41J 2/04563* (2013.01); *B41J 2/0458* (2013.01); *B41J 2/04515* (2013.01);
(Continued)

(58) Field of Classification Search
CPC .... B41J 2/04563; B41J 2/375; B41J 2/04515; B41J 2/04553; B41J 2/42; B41J 11/002; B41J 11/0457
See application file for complete search history.

(56) References Cited

U.S. PATENT DOCUMENTS 5,502,475 A * 3/1996 Kaburagi ..... B41J 11/002 219/216
5,512,924 A * 4/1996 Takada ..... B41J 2/04563 347/18

(Continued)

OTHER PUBLICATIONS

HP Designjet L25500 Printer series—Printer Technologies, (Web Page), 2010.

(Continued)

*Primary Examiner* — Henok Legesse
(74) *Attorney, Agent, or Firm* — HP Inc—Patent Department

(57) ABSTRACT

A method of heating a print zone disposed between a print-head and a media support device of a printing system includes supplying a first amount of power to a heating assembly to form and direct heated air in a first temperature range to the print zone of the printing system. The method also includes determining whether a temperature of the printhead is within a warning temperature range and, if so, supplying a second amount of power that is less than the first amount of power to the heating assembly to form and direct heated air in a second temperature range to the print zone. Otherwise, the first amount of power is continued to be supplied to the heating assembly.

14 Claims, 6 Drawing Sheets

(51) Int. Cl.
*B41J 2/375* (2006.01)
*B41J 11/00* (2006.01)

(52) U.S. Cl.
CPC ..... *B41J 2/04553* (2013.01); *B41J 2/04586* (2013.01); *B41J 2/375* (2013.01); *B41J 2/42* (2013.01); *B41J 11/001* (2013.01); *B41J 11/002* (2013.01)

(56) References Cited

U.S. PATENT DOCUMENTS 5,589,866 A 12/1996 Russell et al.
6,397,488 B1 * 6/2002 Brinkly ..... B41J 11/002 101/424.1
6,481,842 B2 11/2002 Beehler et al.
6,644,774 B1 11/2003 Burger et al.
6,877,247 B1 4/2005 DeMoore
2004/0109054 A1 6/2004 Martin et al.
2004/0119764 A1 6/2004 Speckhart
2006/0284915 A1 * 12/2006 Han ..... B41J 2/04515 347/17
2007/0008381 A1 * 1/2007 Cheng ..... B41J 2/04515 347/61
2009/0244231 A1 10/2009 Tsuji et al.
2011/0148973 A1 6/2011 Chappell et al.
2011/0229664 A1 9/2011 Hoggard
2012/0050372 A1 * 3/2012 Yamaguchi ..... B41J 29/38 347/16
2012/0313996 A1 12/2012 Veis

OTHER PUBLICATIONS

PCT International Search Report and Written Opinion, Jun. 12, 2014, PCT Application No. PCT/US2013/060517, Korean Intellectual Property Office, 12 pages.

* cited by examiner

SELECTIVELY HEATING A PRINT ZONE OF A PRINTING SYSTEM

CROSS-REFERENCE TO RELATED APPLICATION

This application is a U.S. National Stage Application of and claims priority to International Patent Application No. PCT/US2013/060517, filed on Sep. 19, 2013, and entitled "SELECTIVELY HEATING A PRINT ZONE OF A PRINTING SYSTEM," which is hereby incorporated by reference in its entirety.

BACKGROUND

Printing systems include printheads to form images on media in it zones. In large format printers, and the like, the temperature in the print zone may impact the image quality of the printed media. Additionally, the health of the printhead may be influenced by the temperature therein.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Printing systems include printheads to selectively apply printing fluid to form images on media in print zones. In printing systems, such as large format printers, the respective temperature in the print zone may impact the image quality of the printed media. For example, temperatures below an acceptable temperature range in the print zone may cause the printing fluid to not property form on the media. Thus, the image quality of the printed image may be reduced. Alternatively, temperatures above an acceptable range in the print zone may contribute to overheating and/or unwanted fatal air ingestion by the printhead. Thus, the lifespan of the printhead may be reduced.

In examples, a printing system includes, amongst other things, a heating assembly to selectively form and direct heated air to a print zone. The printing system also includes a power modulation module to selectively supply a first amount of power to the heating assembly to form and direct heated air within a first temperature range to the print zone, and to supply a second amount of power to the heating assembly to form and direct heated air in a second temperature range that is less than the first temperature range to the print zone. The power modulation module also may selectively deactivate the heating assembly based on a detection of a temperature of the printhead. Thus, a respective temperature range may be maintained in the print zone that increases image, quality of the printed image and the lifespan of the printhead.

Figure 1:
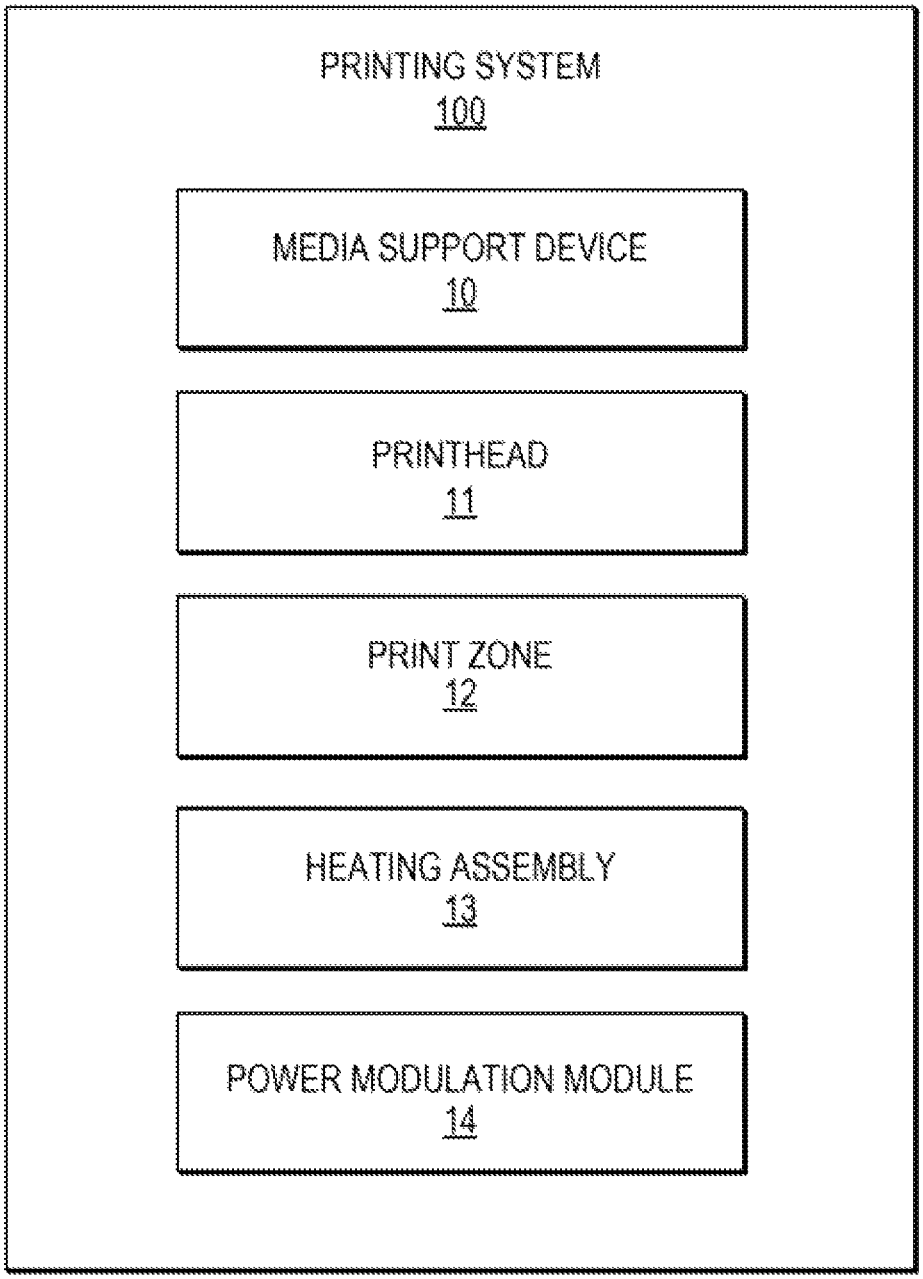
FIG. 1 is a block diagram illustrating a printing system according to an example.

FIG. 1 is a block diagram illustrating a printing system according to an example. Referring to FIG. 1, in some examples, a printing system 100 includes a media support device 10, a printhead 11, a print zone 12, a heating assembly 13, and a power modulation module 14. The media support device 10 may support a media. In some examples, the media may include web material, sheet material, and the like. The printhead 11 may selectively print an image on the media with printing fluid. The printhead 11 may include at least one temperature sensitive resistor to detect a temperature within the printhead 11. The print zone 12 may be disposed between the printhead 11 and the media support device 10. The heating assembly 13 may selectively form and direct heated air to the print zone 12.

Referring to FIG. 1, in some examples, the power modulation module 14 may selectively supply a first amount of power to the heating assembly 13 to form and direct heated air within a first temperature range to the print zone 12. The power modulation module 14 may also selectively supply a second amount of power to the heating assembly 13 to form and direct heated air in a second temperature range to the print zone 12. In some examples, the second temperature range is less than the first temperature range. The power modulation module 14 may also selectively deactivate the heating assembly 13 based on a detection of the temperature by the at least one temperature sensitive resistor of the printhead 11. In some examples, the printhead 11 may be configured to initially print an image on the media in the print zone 12 after the first amount of power is supplied to the heating assembly 13.

Figure 2:
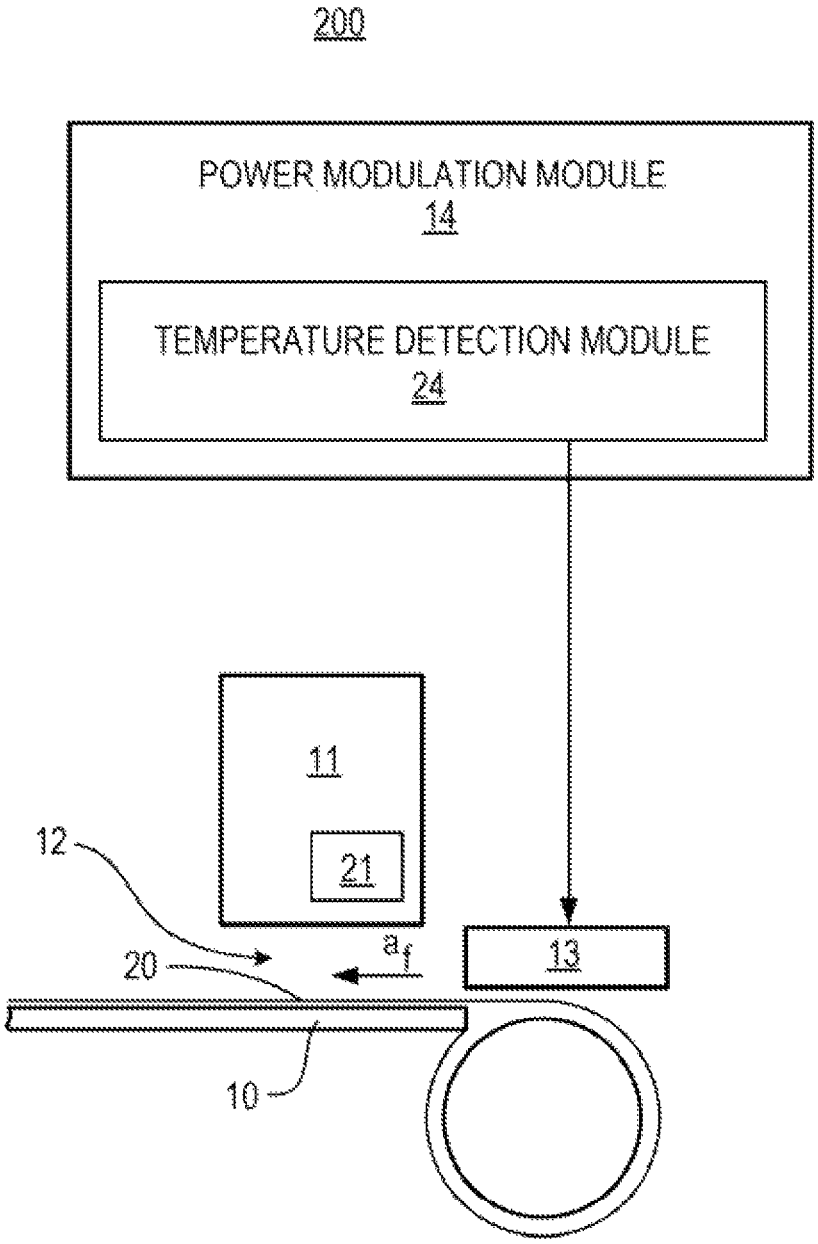
FIG. 2 is a schematic view illustrating a printing system according to an example.
Figure 3:
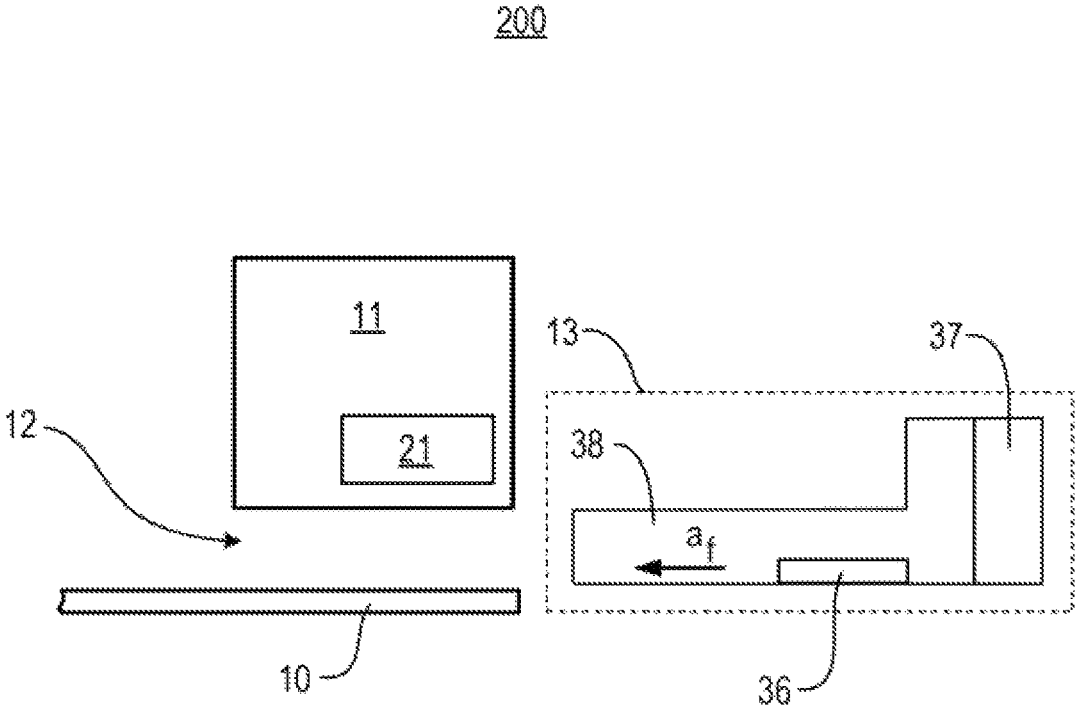
FIG. 3 is a schematic view illustrating a print zone and heating assembly of the printing system of FIG. 2 according to an example.
Figure 4:
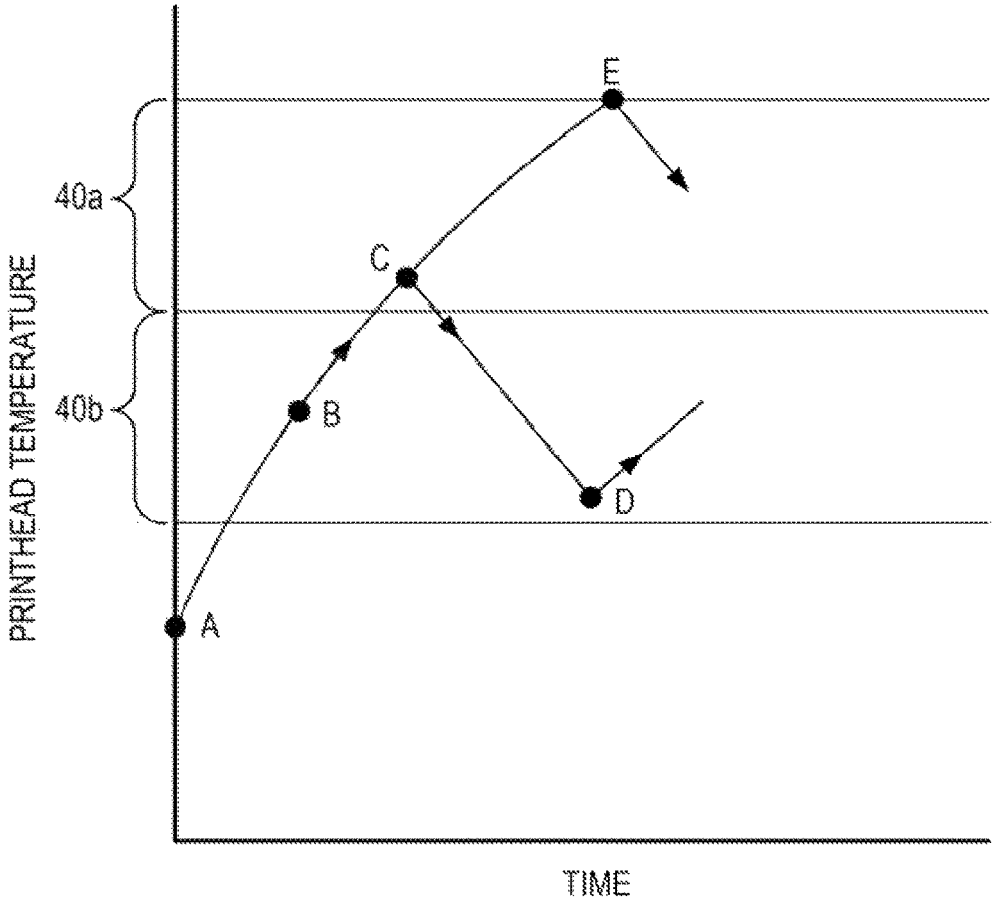
FIG. 4 is a graph illustrating respective temperatures with respect to time in a printhead of the printing system of FIG. 2 according to an example.

FIG. 2 is a schematic view illustrating a printing system according to an example. FIG. 3 is a schematic view illustrating a print zone and heating assembly of the printing system of FIG. 2 according to an example. FIG. 4 is a graph illustrating respective temperature with respect to time in the printhead of the printing system of FIG. 2 according to an example. Referring to FIGS. 2-4, in some examples, a printhead system 200 may include the media support device 10, the printhead 11, the print zone 12, the heating assembly 13 and the power modulation module 14 as previously described with respect to the printing system 100 of FIG. 1.

Referring to FIGS. 2-4, in some examples, the media support device 10 may include a platen to support and position the media in the print zone 12, a media transport member to support the media in the print zone 12 and to move the media to and from the print zone, and the like. In some examples, the printhead 11 may selectively print an image on the media 20 with printing fluid. In some examples, the printhead 11 may include a plurality of printhead modules, a printbar, a printhead assembly, and the like. For example, the printhead 11 may include an inkjet printhead such as a thermal inkjet printhead to eject printing fluid onto the media 20. The printing fluid, for example, may include ink such as latex ink, ultraviolet radiation curable ink, and the like. The printhead 11 may include at least one temperature sensitive resistor 21 to detect a temperature within the printhead 11.

Referring to FIGS. 2-4, in some examples, the print zone 12 may be disposed between the printhead 11 and the media support device 12. The print zone 12 may correspond to an area between and adjacent to the printhead 11 and the media support device 12 in which printing fluid is applied there through from the printhead 11 to the media 20 disposed on the media support device 10 therein. For example, the print zone 12 may be directly below a nozzle surface of a thermal inkjet printhead and above a surface of the media support member 10 to support the media 20.

Referring to FIGS. 2-4, in some examples, the heating assembly 13 may include a plurality of resistors 36, an air flow generating unit 37, and a conduit 38. The plurality of resistors 36 may produce heat. For example, power in the form of an electric current may be applied to the resistors 36 to generate heat therefrom. In some examples, the amount of heat generated by the resistors 38 may vary base on the amount of power that is applied thereto, for example, by the power modulation module 14. The airflow generating unit 37 may direct air pass the plurality of resistors 36 to form heated air, and to direct the heated air $a_f$ to the print one 12. In some examples, the amount of air generated by the air flow generating unit 37 may be selectively controlled. The conduit 38 may pass the heated air from the plurality of resistors 36 to the print zone 12. That is, the it flow generated by the air flow generating unit 37 may be directed proximate to the resistors 36 to be heated and through the conduit 38 to the print zone 12.

Referring to FIGS. 2-4, in some examples, the power modulation module 14 may initially supply a first amount of power to the heating assembly 13, for example, upon startup of the printing system 200, and/or after a prolonged printing delay as illustrated at point A of FIG. 4. That is, the print zone 12 may be quickly heated prior to printing an image on the media 20 by the printhead 11. The power modulation module 14 may also include a temperature detection module 24. The temperature detection module 24 may determine whether the temperature of the printhead 11 is within a warning temperature range 40*a*, continue supplying the first amount of power to the heating assembly 13 in response to a determination that the temperature of the printhead 11 is not within the warning temperature range 40*a* as illustrated at point B of FIG. 4, and supply a second amount of power that is less than the first amount of power to the heating assembly 13 in response to a determination that the temperature of the print head 11 is within the warning temperature range 40*a* as illustrated at point C in FIG. 4.

Referring to FIGS. 2-4, in some examples, the temperature detection module 24 may subsequently determine whether the temperature of the print head 11 is within an acceptable temperature range 40*b* in response to the supplying the second amount of power to the heating assembly 13, supply the first amount of power to the heating assembly 13 in response to a determination that the temperature of the printhead 11 is within the acceptable temperature range 40*b* as illustrated at point D of FIG. 4, and deactivate the heating assembly 13 in response to a determination that the temperature of the printhead 11 is within the warning temperature range 40*a* at point E of FIG. 4.

In some examples, the power modulation modulation 14 and/or the temperature detection module 24 may be implemented in hardware, software including firmware, or combinations thereof. The firmware, for example, may be stored in memory and executed by a suitable instruction-execution system. If implemented in hardware, as in an alternative example, the power modulation module 14 and/or the temperature detection module 24 may be implemented with any or a combination of technologies which are well known in the art (for example, discrete-logic circuits, application-specific integrated circuits (ASICs), programmable-gate arrays (PGAs), field-programmable gate arrays (FPGAs)), and/or other later developed technologies. In some examples, the power modulation module 14 and/or the temperature detection module 24 may be implemented in a combination of software and data executed and stored under the control of a computing device.

Figure 5:
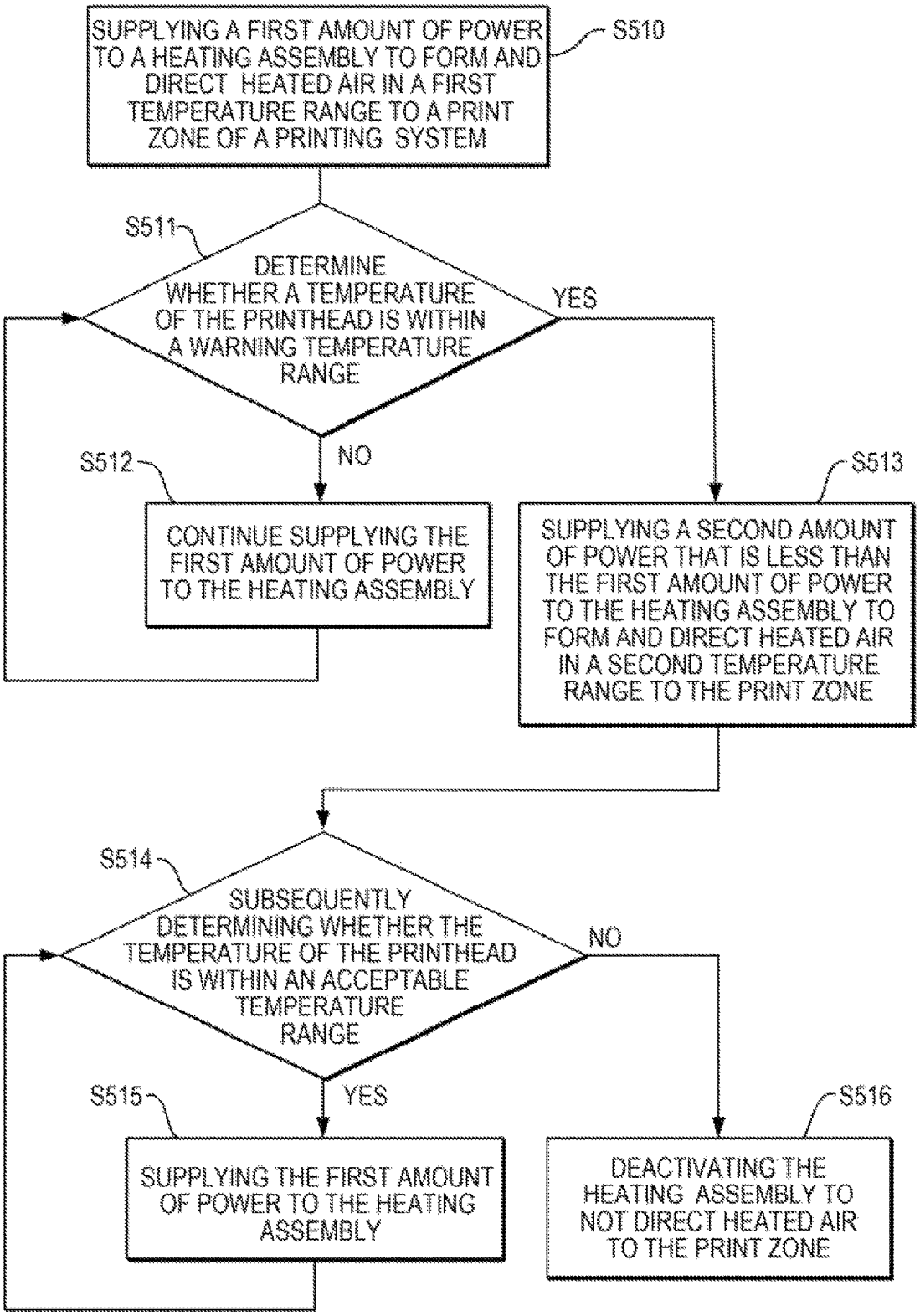
FIG. 5 is a flowchart illustrating a method of heating a print zone disposed between a printhead and a media support device at a printing system according to an example.

FIG. 5 is a flowchart illustrating a method of heating a print zone disposed between a printhead and a media support device of a printing system according to an example. In some examples, the modules and/or assemblies implementing the method may be those described in relation to the printing systems 100 and 200 of FIGS. 1-4. Referring to FIG. 5, in block S510, a first amount of power is supplied to a heating assembly to form and direct heated air in a first temperature range to the print zone of the printing system. In block S511, whether a temperature of the printhead is within a warning temperature range is determined. In block S512, the first amount of power is continued to be supplied to the heating assembly in response to a determination that the temperature of the printhead is not within the warning temperature range. Subsequently, in some examples, whether a temperature of the printhead is within a warning temperature range is again determined (S511).

In block S513, a second amount of power that is less than the first amount of power is supplied to the heating assembly to form and direct heated air in a second temperature range to the print zone in response to a determination that the temperature of the printhead is within the warning temperature range. If so, in block S514, whether the temperature of the printhead is within an acceptable temperature range is subsequently determined. In block S155, the first amount of power is supplied to the heating assembly in response to a determination that the temperature of the printhead is within the acceptable temperature range. Subsequently, in some examples, whether a temperature of the printhead is within the acceptable temperature range is again determined (S514).

In block S516, the heating assembly is deactivated to not direct heated air to the print zone in response to a determination that the temperature of the printhead not within the acceptable temperature range. In some examples, in response to the deactivating the heating assembly, whether the temperature of the printhead is within the acceptable temperature range is determined, and if so, the second amount of power is supplied to the heating assembly (e.g., in response to a determination that the temperature of the printhead is within the acceptable temperature range). If not, the heating assembly is continually deactivated (e.g., in response to a determination that the temperature of the printhead is not within the acceptable temperature range).

Alternatively, in some examples, whether the temperature of the printhead is within the acceptable temperature range is subsequently determined in response to the supplying the second amount at power to the heating assembly, and if so, the first amount of power is supplied to the heating assembly (e.g., in response to a determination that the temperature of the printhead is within the acceptable temperature range). If not, the heating assembly is deactivated to not direct heated air to the print zone (e.g., in response to a determination that the temperature of the printhead is not within the acceptable temperature range).

Figure 6:
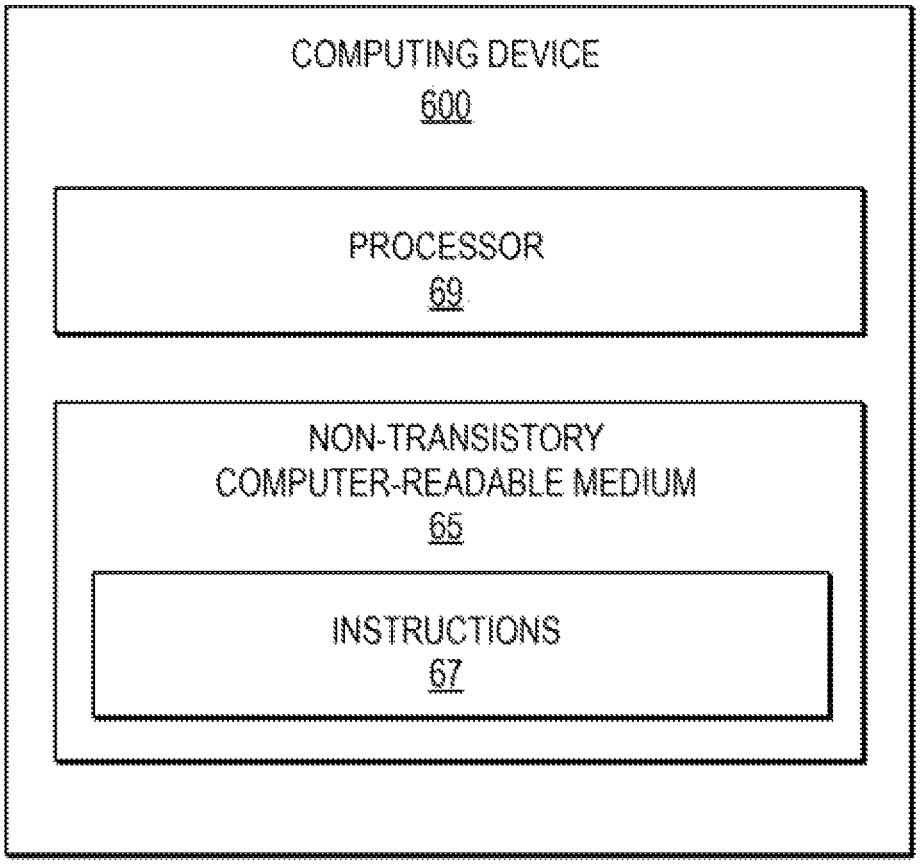
FIG. 6 is a block diagram illustrating a computing device such as a printing system including a processor and a non-transitory, computer-readable storage medium to store instructions to operate a printing system to heat a print zone disposed between a print head and a media support device thereof according to an example.

FIG. 6 is a block diagram illustrating a computing device such as a printing system including a processor and a non-transitory, computer-readable storage medium to store instructions to operate the printing system to heat a print zone disposed between a printhead and a media support device according to an example. Referring to FIG. 6, in some examples, the non-transitory, computer-readable storage medium 65 may be included in a computing device 600 such as a printing system including a power modulation module 44 (FIGS. 1-4). In some examples, the non-transitory, computer-readable storage medium 65 may be implemented in whole or in part as instructions 67 such as computer-implemented instructions stored in the computing device locally or remotely, for example, in a server or a host computing device 600 considered herein to be part of the printing system.

Referring to FIG. 6, in some examples, the non-transitory, computer-readable storage medium 65 may correspond to a storage device that stores instructions 67, such as computer-implemented instructions and/or programming code, and the like. For example, the non-transitory, computer-readable storage medium 65 may include a non-volatile memory, a volatile memory, and/or a storage device. Examples of non-volatile memory include, but are not limited to, electrically erasable programmable read only memory (EEPROM) and read only memory (ROM). Examples of volatile memory include, but are not limited to, static random access memory (SRAM), and dynamic random access memory (DRAM). In some examples, the power modulation module 14 may include the computer-readable storage medium 65.

Referring to FIG. 6, examples of storage devices include, but are not limited to, hard disk drives, compact disc drives, digital versatile disc drives, optical drive, and flash memory devices. In some examples, the non-transitory, computer-readable storage medium 65 may even be paper or another suitable medium upon which the instructions 67 are printed, as the instructions 67 can be electronically captured, via, for instance, optical scanning of the paper or other medium, then compiled, interpreted or otherwise processed in a single manner, it necessary, and then stored therein. A processor 69 generally retrieves and executes the instructions 67 stored in the non-transitory, computer-readable storage medium 65, for example, to operate computing device 600. In an example, the non-transitory, computer-readable storage medium 65 can be accessed by the processor 69.

It is to be understood that the flowchart of FIG. 5 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 5 illustrates a specific order of execution, the order of execution may differ from that which is depicted. For example, the order of execution of two or more blocks may be rearranged relative to the order illustrated. Also, two or more blocks illustrated in succession in FIG. 5 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or "including but not necessarily limited to."

It is noted that some of the described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A printing system, comprising:

a media support device to support a media;

printhead including at least one temperature sensitive resistor to detect a temperature therein, the printhead to selectively print an image on the media;

a print zone disposed between the printhead and the media support device;

a heating assembly to selectively form and direct heated air to the print zone; and a power modulation module to selectively supply a first amount of power to the heating assembly to form and direct heated air within a first temperature range to the print zone, supply a second amount of power to the heating assembly to form and direct heated air in a second temperature range to the print zone, and deactivate the heating assembly based on a detection of the temperature by the at least one temperature sensitive resistor of the printhead;

wherein the second temperature range is less than the first temperature range; and wherein the power modulation module further comprises:

a temperature detection module to determine whether the temperature of the printhead is within a warning temperature range, continue supplying the first amount of power to the heating assembly in response to a determination that the temperature of the printhead is not within the warming temperature range, and supply a second amount of power that is less than the first amount of power to the heating assembly in response to a determination that the temperature of the printhead is within the waring temperature range.

2. The printing system of claim 1, wherein the second amount of power is substantially fifty percent at the first amount of power.

3. The printing system of claim 1, wherein the heating assembly comprises:

a plurality of resistors to produce heat; and an air flow generating unit to direct air pass the plurality a resistors to form heated air, and to direct the heated air to the print zone.

4. The printing system of claim 3, wherein the heating assembly further comprises:

a conduit to pass the heated air from the plurality of resistors to the print zone.

5. The printing system of claim 1, wherein the temperature detection module is configured to subsequently determine whether the temperature of the printhead is within an acceptable temperature range in response to the supplying the second amount of power to the heating assembly, supply the first amount of power to the heating assembly in response to a determination that the temperature of the printhead is within the acceptable temperature range, and deactivate the heating assembly in response to a determination that the temperature of the printhead is not within the acceptable temperature range.

6. The printing system of claim 5, wherein the printhead is configured to print an image on the media in the print on after the first amount of power is supplied to the heating assembly.

7. A method of heating a print zone disposed between a printhead and a media support device of a printing system, the method comprising:

supplying a first amount of power to a heating assembly to form and direct heated air in a first temperature range to the print zone of the printing system;

determining whether a temperature of the printhead is within a warning temperature range; and:

continue supplying the first amount of power to the heating assembly in response to a determination that the temperature of the printhead is not within the warning temperature range; and supplying a second amount of power that is less than the first amount of power to the heating assembly to form and direct heated air in a second temperature range to the print zone in response to a determination that the temperature of the printhead is within the warning temperature range and, if so:

subsequently determining whether the temperature of the printhead is within an acceptable temperature range; and:

supplying the first amount of power to the heating assembly in response to a determination that the temperature of the printhead is within the acceptable temperature range; and deactivating the heating assembly to not direct heated air to the print zone in response to a determination that the temperature of the printhead is not within the acceptable temperature range.

8. The method of claim 7, further comprising:

determining whether the temperature of the printhead is within the acceptable temperature range in response to the deactivating the heating assembly; and:

supplying the second amount of power to the heating assembly in response to a determination that the temperature of the printhead is within the acceptable temperature range; and continue deactivating the heating assembly in response to a determination that the temperature of the printhead is not within the acceptable temperature range.

9. The method of claim 8, further comprising:

subsequently determining whether the temperature of the printhead is within the acceptable temperature range in response to the supplying the second amount of power to the heating assembly, and:

supplying the first amount of power to the heating assembly in response to a determination that the temperature of the printhead is within the acceptable temperature range; and deactivating the heating assembly to not direct heated air to the print zone in response to a determination that the temperature of the printhead is not within the acceptable temperature range.

10. The method of claim 7, further comprising:

printing an image on a media in the print zone by the printhead after the first amount of power is supplied to the heating assembly.

11. The method of claim 7, wherein the second amount of power is substantially fifty percent of the first amount of power.

12. The method of claim 7, wherein the deactivating the heating assembly further comprises:

supplying substantially no power to the heating assembly.

13. The method of claim 7, wherein the second temperature range is less than the first temperature range.

14. A non-transitory computer-readable storage medium having computer executable instructions stored thereon to operate a printing system to heat a print zone disposed between a printhead and a media support device thereof, the instructions are executable by a processor to:

supply a first amount of power to a heating assembly to form and direct heated air within a first temperature range to the print zone; and determine whether a temperature of the printhead is within a warning temperature range; and:

continue supplying the first amount of power to the heating assembly in response to a determination that the temperature of the printhead is not within the warning temperature range; and supply a second amount of power that is less than the first amount of power to the heating assembly in response to a determination that the temperature of the printhead is within the warning temperature range.

* * * * *